US007663558B2

(12) United States Patent
Luong

(10) Patent No.: US 7,663,558 B2
(45) Date of Patent: Feb. 16, 2010

(54) TAG READER WITH CONFORMAL ANTENNA STAND

(75) Inventor: Ngoc Minh Luong, Selden, NY (US)

(73) Assignee: Motorola, Inc., Holtsville, NY (US)

( * ) Notice: Subject to any disclaimer, the term of this patent is extended or adjusted under 35 U.S.C. 154(b) by 230 days.

(21) Appl. No.: 11/954,384

(22) Filed: Dec. 12, 2007

(65) Prior Publication Data

US 2009/0153406 A1 Jun. 18, 2009

(51) Int. Cl.
*H01Q 1/24* (2006.01)

(52) U.S. Cl. ..... 343/702; 343/873; 29/600

(58) Field of Classification Search ..... 343/702, 343/700 MS, 718, 873; 29/600
See application file for complete search history.

(56) References Cited

U.S. PATENT DOCUMENTS 5,822,714 A * 10/1998 Cato ..... 702/108
6,326,022 B1 12/2001 Katz
2007/0075142 A1* 4/2007 Bellows et al. ..... 235/451
2008/0177591 A1* 7/2008 Mattlin et al. ..... 705/7
2008/0297355 A1* 12/2008 Matsumoto et al. ..... 340/572.7

* cited by examiner

*Primary Examiner*—HoangAnh T Le
(74) *Attorney, Agent, or Firm*—Gregory L. Thorne; Thorne & Halajian, LLP

(57) ABSTRACT

A mobile device includes a housing having a transceiver configured to transmit and/or receive a signal. A stand attachable to the housing has a profile that increases stability of the housing in a resting position. The stand may also be attachable to a further housing such as an interface device configured for connection or attachment to the housing of the mobile device. The stand may include a first portion connectable to the wireless mobile device, a second portion, and an antenna having holes and being sandwiched between the first portion and the second portion. The antenna holes may be configured for allowing passage of liquid material during molding together the first portion, the second portion and the antenna to form a molded stand. The antenna may be operationally coupled to the transceiver. A base plate having hole(s) and connector(s) may also be sandwiched between the first portion and the antenna.

20 Claims, 2 Drawing Sheets

TAG READER WITH CONFORMAL ANTENNA STAND

FIELD OF THE INVENTION

The present invention relates to a stand and a mobile device attachable to the stand that also protects the mobile device and includes an antenna connectable to the mobile device.

BACKGROUND OF THE INVENTION

Mobile devices have increased exponentially, and include various electronic devices, such as mobile phones, mobile computers, personal digital assistants (PDAs), remote controller, scanners, etc. Mobile devices often communicate wirelessly to other devices through an antenna to exchange information. For example, wireless scanner devices often referred to as scanning guns, such as used at retail stores, warehouses and the like to scan items, have an antenna used to wirelessly receive and transmit (scanned) information. For example, a scanning gun may scan or read/receive information from tags including bar codes (for optical scanner) or RFID tags (for wireless tag scanning). The tags may be attached to various products and include information related to the attached product, such as identification of the product, price of the product, storage location of the product in a warehouse or a shelf, etc.

Typically, the antenna is part of the wireless mobile device. However, in such cases, the likelihood of interference with circuits of the mobile device, e.g., a scanning gun, increases during reception or transmission of signals by the antenna of the scanning gun. To reduce such interference, the antenna may be external to the mobile device and attached by a cable. However, external antennas are typically not well protected and thus may break or not withstand harsh environment or use. Accordingly, there is a need for improved wireless mobile devices where such interference is reduced via properly locating the antenna and yet be unobtrusive, as well as making the antenna and the wireless device withstand harsh environment and use.

SUMMARY OF THE INVENTION

One object of the present systems, devices and methods is to overcome the disadvantages of conventional wireless mobile devices.

This and other objects are achieved by systems, devices and methods comprising a wireless mobile device that includes a housing having a transmitter and/or a receiver configured to transmit and/or receive a signal. A stand is attachable to the housing and has a profile that increases stability of the housing in a resting position. The stand may also be attachable to a further housing such as an interface device configured for connection or attachment to the housing of the mobile device.

The stand may include a first portion connectable to the wireless mobile device, a second portion, and an antenna having holes and being sandwiched between the first portion and the second portion. The antenna holes may be configured for allowing passage of liquid material during molding together the first portion, the second portion and the antenna to form a molded stand. The antenna may be operationally coupled to the transmitter and/or receiver.

A base plate may also be sandwiched between the first portion and the antenna. The base plate may include at least one connector extending through the first portion for connection to the housing. In this embodiment, the antenna may be operationally coupled to circuits or elements of the mobile device through the connector of the base plate.

Further areas of applicability of the present systems, devices and methods will become apparent from the detailed description provided hereinafter, such as providing a triple function by a single unit or stand, namely, an antenna function, a stand function for an attached device and a protection function for the attached device, e.g. the wireless mobile device. It should be understood that the detailed description and specific examples, while indicating exemplary embodiments of the systems, devices and methods, are intended for purposes of illustration only and are not intended to limit the scope of the invention.

BRIEF DESCRIPTION OF THE DRAWINGS

These and other features, aspects, and advantages of the apparatus, systems and methods of the present invention will become better understood from the following description, appended claims, and accompanying drawings.

It should be expressly understood that the drawings are included for illustrative purposes and do not represent the scope of the present system, where.

DETAILED DESCRIPTION OF THE INVENTION

The following description of certain exemplary embodiments is merely exemplary in nature and is in no way intended to limit the invention, its application, or uses. For example, illustrative embodiments are described related to a scanning device or gun configure to read tags, such as RFID tags attached to various products or items. However, it should be understood that the present systems, devices and methods are not limited for use with scanning guns, and may be used with any device requiring an antenna, for example.

In the following detailed description of embodiments of the present systems, devices and methods, reference is made to the accompanying drawings which form a part hereof, and in which are shown, by way of illustration, specific embodiments in which the described systems and methods may be practiced. These embodiments are described in sufficient detail to enable those skilled in the art to practice the presently disclosed system, and it is to be understood that other embodiments may be utilized and that structural and logical changes may be made without departing from the spirit and scope of the present system.

The following detailed description is therefore not to be taken in a limiting sense, and the scope of the present system is defined only by the appended claims. The leading digit(s) of the reference numbers in the figures herein typically correspond to the figure number, with the exception that identical components which appear in multiple figures are identified by the same reference numbers. Moreover, for the purpose of clarity, detailed descriptions of well-known devices and methods are omitted so as not to obscure the description of the present system.

Figure 1:
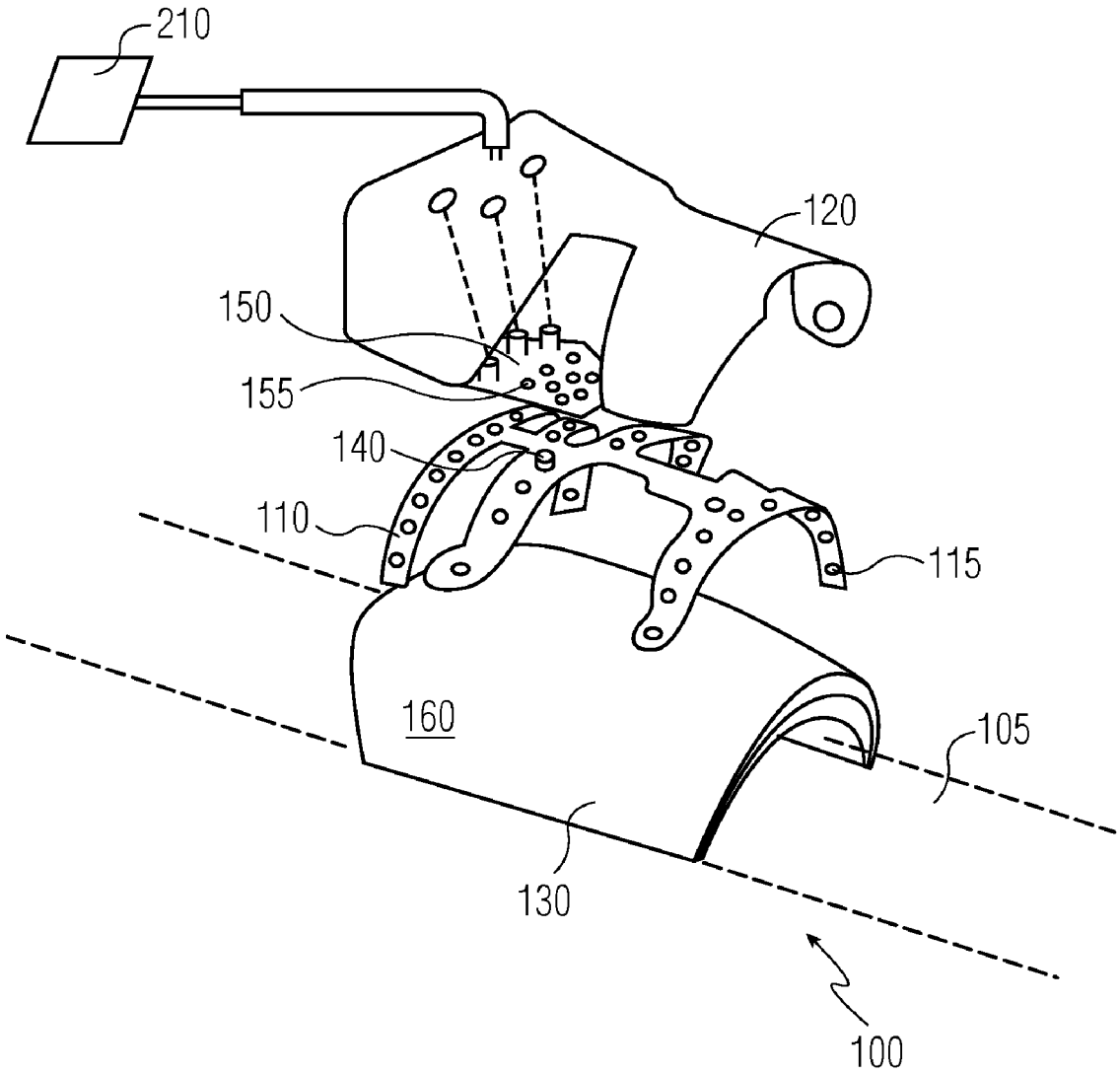
FIG. 1 shows expanded view showing portions of an illustrative device in accordance with an embodiment of the present system.
Figure 2:
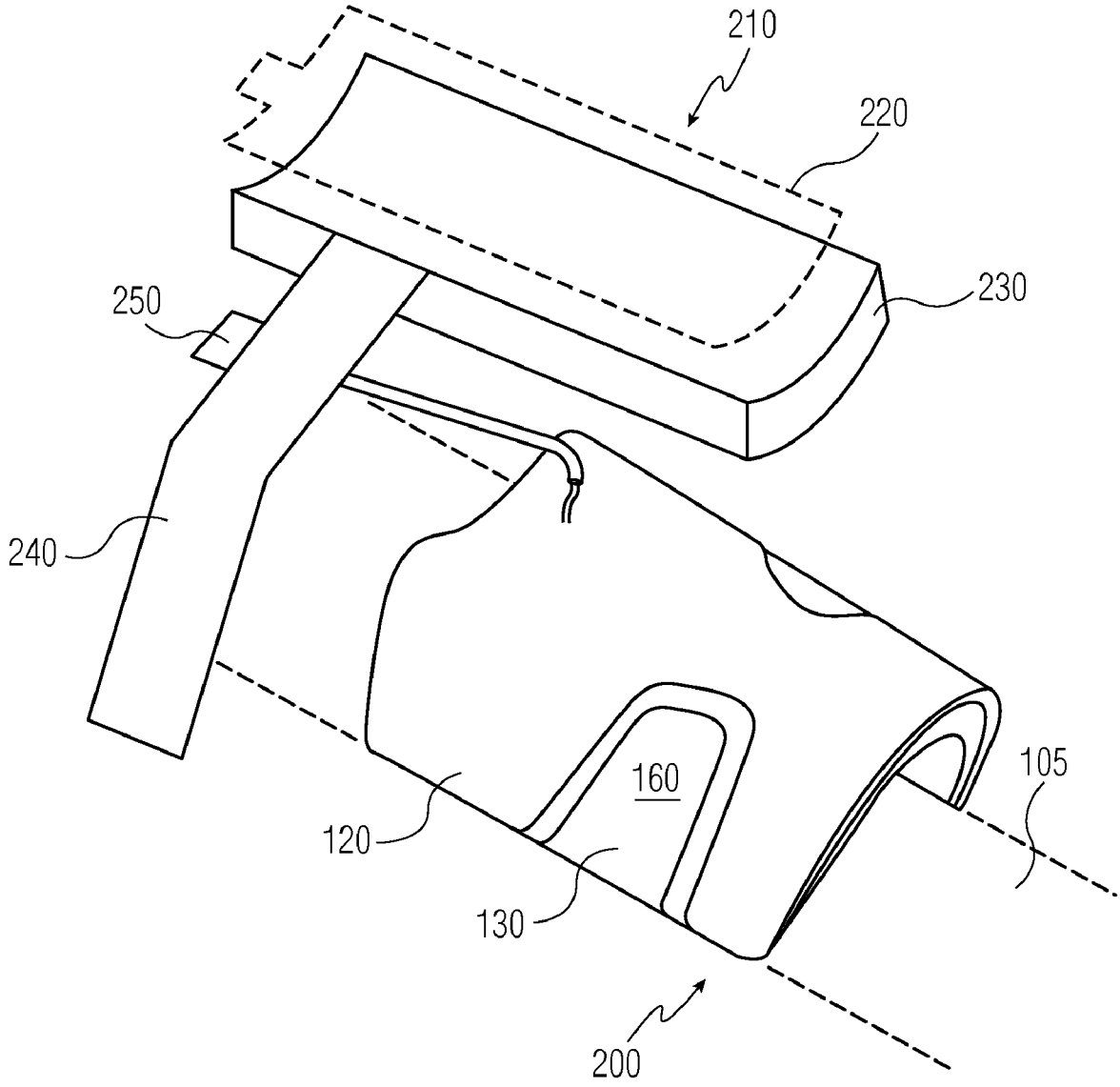
FIG. 2 shows an assembled illustrative system in accordance with an embodiment of the present system.

FIGS. 1-2 show an illustrative device in accordance with an embodiment, referred to as an antenna stand, shown as unassembled stand 100 in FIG. 1 and an assembled stand 200 in FIG. 2. For simplicity, the antenna stand will be referred to by numeral 100. The antenna stand 100 is shaped to fit over an arm/wrist/hand 105 of a user of a wireless mobile device 210 attached to the antenna stand 100, such as a scanner gun 210 shown in FIG. 2 as dashed lines and shown in FIG. 1 as a box. Illustratively, the antenna stand 100 may include straps to securely hold it over the user's arm 105, which may include Velcro™ straps or other hook-and-loop fasteners. The antenna stand 100 may also be resilient to biasely provide a force toward the arm to grip the arm for secure attachment.

The scanner gun 210 may be attached directly (via its scanner housing 220) to the antenna stand 100, or through a separate housing such as an interface device 230. The interface device 230 may be configured to interchangeably accept (or be operationally connected to) different scanner guns, where each scanner may having its own scanner housing.

Illustratively, the interface device 230 (or the scanner gun 210) may have a handle 240 with a trigger 250 configured to activate the scanner 210 for scanning an RFID tag upon pressing or squeezing the trigger 250 by a finger of the user, for example. As is well known, the scanner includes a transceiver (or a transmitter and a receiver) and upon activation, reads a tag, such as an RFID tag, by transmitting a signal and receiving information from the RFID tag. The information received from the RFID tag may include any desired data, such as identification of the tag and/or a product (associated with, e.g., attached to the RFID tag), and/or the location associated with the tag/product, including any other desired data, selectively rendered on a humanly perceptible device such as a display device. The display device may be integral with and/or remote from the scanner, and connectable to the scanner by any means, wired or wireless, directly or through a network. The data may further include the price, manufacturer and/or specification of the product, and the like.

As shown in FIGS. 1-2, the antenna stand 100 has a shape or profile that increases stability of an attached unit, such as the scanner 210 or the interface device 300, in resting position, such as when the attached scanner-stand combination is placed on a table or surface such as a substantially flat surface in a resting or storage position of the stand and/or the attached scanner-stand combination. Illustratively, the antenna stands may be stackable over each other to reduce storage room requirements.

FIG. 1 shows various components of the antenna stand 100, namely, an antenna 110 formed by metal strips, e.g., copper strips having a thickness of 0.008 inches, molded into a substrate 120. The antenna 110 may be designed to operate at any desired frequency, such as in the range of 1-10 GHz, for example. Further, the antenna 110 may be shaped, e.g., curved, to also provide a mechanical function in addition to receiving and transmitting signals. The metal strips of the antenna 110 have holes 115 to provide passage of heated liquid material during molding the antenna 110 into the substrate 120. Of course, instead of molding, the antenna 110 may be attached e.g., glued to the substrate 120.

Next, the attached substrate 120 and antenna strips 110 are sandwiched and sealed by a rigid material which is RF friendly, thus having low losses and low dielectric constant. Instead of encompassing both the substrate 120 and antenna strips 110, the rigid material may be formed into a rigid portion covering one side (such as the antenna or lower side) of the attached substrate 120 and antenna strips 110 to form a lower rigid portion 130. In this case, the antenna strips 110 are sandwiched between the substrate 120 and the rigid portion 130.

Illustratively, the attached substrate 120 and antenna strips 110 are placed in a mold and heated liquid material is injected into the mold to flow through the holes 115 of the antenna strips 110 for better attachment and formation of a molded antenna stand 100.

The material forming both the substrate 120 and the rigid cover 130 may be the same or different, and both may be RF friendly with low dielectric constant(s) and low losses at the operating frequency range of the antenna. Such material may include rubber, elastomeric polymers, Room Temperature Vulcanizing (RTV) silicon rubber, or thermoplastic elastomers such as Dynaflex™ provided by the Dow Corning Corporation. Illustratively, the lower rigid cover 130 is Dynaflex™ 7980 series, such as 7980-1, and the substrate 120 is more flexible and may be rubber, flexible plastic, or any other flexible or semi-rigid material with low RF losses, particularly in the operating frequency range of the antenna.

As is well known in the field of injection molding, pellets of selected RF friendly material having a desired flexibility and/or rigidity, such as Dynaflex™ 7980-1, are placed in a heated chamber of a molding machine, e.g., heated to 185° C., mixed or rotated to obtain a uniform melt of the polymer, and injected into a mold which includes the antenna strip 110 attached to the substrate 120, e.g., attached by bonding, e.g., via adhesive, or by a similar molding process. Upon subsequent cooling to room temperature and removing the mold, the molded antenna stand 100 is obtained.

The holes 115 of the antenna strip 110 allow passage of heated liquid material during the molding process(s) and provide for better attachment of the various components of the molded stand. It should be understand that the antenna 110 may be attached to the substrate 120, also referred to as a first portion, by means other then using an adhesive, including using any type of fasteners, as well as using an injection molding process.

For example, some of the antenna holes may be temporarily covered and the antenna placed in a mold for injecting heated liquid material which flow through a set of the antenna holes 115 that are not covered and, when cooled to room temperature, form the substrate 120 attached to the antenna 110, partially due to the material that had flown through the open antenna holes 115. The set of antenna holes that were covered may now be uncovered and another injection molding process performed to form the lower rigid portion 130 which may be attached to the antenna 110 partially or wholly due the flow of its material in the heated liquid form through the set of uncovered holes of the antenna 110.

The rigid portion 130 (whether only at the lower portion facing away from the substrate 120 or encompassing both the antenna strips 110 and the substrate 120), provides a rigid antenna stand 100 that protects the antenna 110 as well as the wireless mobile device 210, and/or the interface device 230 attached to the antenna stand 100.

The antenna 110 may have a connector 140 for operationally coupling to the transceiver of the scanner gun 210, directly or through the interface device 230. The antenna connector 140 may extend through the substrate 120, where the antenna connector 140 is configured to mate via a connection to the scanner gun 210 either directly through a mating connector of the scanner gun 210 or though a cable, e.g., a coaxial cable, connected between the connectors of the scanner gun 210 and the antenna 110.

Alternatively, or in addition, the antenna stand 100 may further comprise a base plate 150 operationally coupled to the antenna 110 and included between the antenna 110 and the substrate. The base plate 150 may also have holes 155 for flow of the heated liquid material during the molding process(s) for better attachment and formation of a molded antenna stand 100. That is, the base plate 150 and the antenna 110 may be attached to the substrate 120 by an injection molding, for example.

Alternatively, the base plate 150 may be bonded, e.g., via an adhesive to the substrate 120 and/or the antenna 110, and the rigid cover 130 may be formed by injection molding to all or portions of the attached combination of the substrate 120, the base plate 150 and the antenna 110. In the case where the entire antenna stand 100 is not covered or encompassed by the rigid cover 130, the rigid cover 130 may only cover the lower portion 160 of the antenna stand 100 shown in FIG. 1, on a side facing away from scanner gun 210 or the interface device 230, i.e., the side facing the arm 105 of the user.

Of course, it is to be appreciated that any one of the above embodiments or processes may be combined with one or with one or more other embodiments or processes to provide a desired antenna stand for attachment to a wireless mobile device, and placement on a user's arm during use, for example. In addition, to providing a convenient profile for placement on a human arm 105, for example, the antenna stand 100 also protects the antenna 110, even in harsh environment and use, including preventing damage when the antenna stand is dropped.

Further, the antenna stand 100 allows for safe placement and storage when not in use, such as stored on a table or flat surface, and may be stackable to reduce storage room requirements. The antenna stand may light-weight and fits on the arm of the user to provide convenient placement and attachment of the scanner gun during use. Illustratively, the antenna stand 100 weighs in the range of 1 to 2 pounds, such as about a pound and a half, and has a thickness from about 6 mm (e.g., where each layer or portion 120, 130 is about 3 mm) to about 10 mm or higher, such as 14 mm, at portions that interface with the scanner gun 210 and/or the interface device 230. Both layers or portions 120, 130 may be the same or similar RF friendly material. Having such a robust antenna stand that includes an antenna external to, but operationally coupled to, a wireless mobile device reduces interference with circuit of the wireless mobile device.

Thus, the antenna stand 100 protects the wireless mobile scanner 210, provides an external antenna 110 which is protected and hidden, and provides a stand for the scanner 210.

Other variations and embodiments may include various connections and/or connectors among the various elements, such as among the antenna 110, base plate 150, interface device 230 and/or scanner 210. For example, rigid, semi rigid, and or flexible connections, cables and/or tubing may be provided, such as for passage of cable(s) through the tubing (s).

These and other variations should be understood to be within the scope of the presented claims. As should be clear from the discussion herein, the present system overcomes various disadvantages and/or makes improvements over other systems.

Finally, the above-discussion is intended to be merely illustrative of the present system and should not be construed as limiting the appended claims to any particular embodiment or group of embodiments. Thus, while the present system has been described in particular detail with reference to specific exemplary embodiments thereof, it should also be appreciated that numerous modifications and alternative embodiments may be devised by those having ordinary skill in the art without departing from the broader and intended spirit and scope of the present system as set forth in the claims that follow.

In addition, the section headings included herein are intended to facilitate a review but are not intended to limit the scope of the present system. Accordingly, the specification and drawings are to be regarded in an illustrative manner and are not intended to limit the scope of the appended claims.

In interpreting the appended claims, it should be understood that:

a) the word "comprising" does not exclude the presence of other elements or acts than those listed in a given claim;

b) the word "a" or "an" preceding an element does not exclude the presence of a plurality of such elements;

c) any reference signs in the claims do not limit their scope;

d) several "means" may be represented by the same or different items or structures or functions;

e) any of the disclosed devices or portions thereof may be combined together or separated into further portions unless specifically stated otherwise; and f) no specific sequence of acts or steps is intended to be required unless specifically indicated.

The claimed invention is:

1. An antenna stand attachable to a housing, the antenna stand comprising:

a first portion configured for connection to the housing;

a second portion; and an antenna sandwiched between the first portion and the second portion; wherein the antenna includes antenna holes for allowing passage of liquid material during molding together the first portion, the second portion and the antenna to form a molded stand.

2. The antenna stand of claim 1, wherein the molded stand has a shape that increases stability of the housing when attached to the molded stand in a resting position.

3. The antenna stand of claim 1, further comprising a base plate having at least one connector extending through the first portion for the connection to the housing;

wherein the antenna is operationally coupled to the at least one connector.

4. The antenna stand of claim 3, wherein the base plate includes base holes for allowing the passage of the liquid material.

5. The antenna stand of claim 1, wherein the first portion is formed by injection molding while the antenna is placed in a mold.

6. The antenna stand of claim 1, wherein the antenna is glued to the first portion to form an attached portion for placement in a mold and formation of the second portion by injection molding of heated liquid material of the second portion.

7. A wireless mobile device comprising:

a housing including at least one of a transmitter and a receiver configured to transmit or receive a signal; and a stand attachable to the housing and having a profile that increases stability of the housing in a resting position;

the stand including a first portion connectable to the wireless mobile device, a second portion, and an antenna having holes and being sandwiched between the first portion and the second portion, wherein the antenna is operationally coupled to the at least one of transmitter and receiver.

8. The wireless mobile device of claim 7, wherein the holes are configured for allowing passage of liquid material during molding together the first portion, the second portion and the antenna to form a molded stand.

9. The wireless mobile device of claim 7, further comprising a base plate having at least one connector for attachment to the housing and the antenna.

10. The wireless mobile device of claim 9, wherein the base plate is sandwiched between the first portion and the antenna.

11. The wireless mobile device of claim 9, wherein the at least one connector passes through the first portion for receiving a mating connector for the attachment of the housing.

12. The wireless mobile device of claim 7, wherein material of the second portion in a heated liquid form is configured to pass through the holes of the antenna and adhere to the first portion.

13. The wireless mobile device of claim 7, wherein the first portion is formed by injection molding while the antenna is placed in a mold.

14. The wireless mobile device of claim 7, wherein the antenna is glued to the first portion to form an attached portion for placement in a mold and formation of the second portion by injection molding of heated liquid material of the second portion.

15. The wireless mobile device of claim 7, wherein the second portion has a larger surface area than the first portion and is shaped to fit over an arm of a user.

16. The wireless mobile device of claim 7, further comprising a cable for operationally coupling the antenna to the at least one of transmitter and receiver; the cable being connected to a surface of the antenna facing the first portion.

17. A method of forming an antenna stand comprising the acts of:

forming a first portion;

attaching an antenna having holes to the first portion to form an attached portion;

placing the attached portion in a mold; and injecting a heated liquid into the mold for passage through the holes and formation of a second portion, the second portion being substantially rigid at room temperature;

wherein the second portion covers at least one of the antenna and the attached portion.

18. The method of claim 17, further comprising the act of placing a base plate between the antenna and the first portion.

19. The method of claim 17, wherein the antenna includes a connector which passes through the first molded portion for receiving a mating connector for attachment to a housing.

20. The method of claim 17, wherein the attaching act includes at least one of adhering the antenna to the first portion by an adhesive and placing the antenna in a further mold for injection of melted material of the first portion for passage through a first set of the holes.

* * * * *